US005101994A

United States Patent [19]

Goss, Jr.

[11] Patent Number: 5,101,994

[45] Date of Patent: Apr. 7, 1992

[54] CONTAINER WITH AN ALIGNING CAP AND NECK CONSTRUCTION

[75] Inventor: Elmer H. Goss, Jr., Pawcatuck, Conn.

[73] Assignee: Silgan Plastics Corporation, Chesterfield, Mo.

[21] Appl. No.: 679,795

[22] Filed: Apr. 3, 1991

[51] Int. Cl.[5] ..... B65D 41/00

[52] U.S. Cl. ..... 215/353; 215/341; 215/344

[58] Field of Search ..... 215/344, 345, 31, 329, 215/341, 342, 346, 353, 235, 237

[56] References Cited

U.S. PATENT DOCUMENTS

| | | | |
|---|---|---|---|
| 183,322 | 10/1876 | Newman | 215/353 X |
| 2,621,832 | 12/1952 | Friedman . | |
| 2,818,204 | 12/1957 | Henchert et al. . | |
| 3,121,519 | 2/1964 | Cherba . | |
| 3,131,836 | 5/1964 | Van Baarn . | |
| 3,168,969 | 2/1965 | Krieps . | |
| 3,194,453 | 7/1965 | Cherba . | |
| 3,227,332 | 1/1966 | Gowdy et al. . | |
| 3,261,515 | 7/1966 | Luedtke . | |
| 3,578,223 | 5/1971 | Armour . | |
| 3,690,497 | 9/1972 | Lecinski, Jr. | 215/346 X |
| 3,888,373 | 6/1975 | Gach et al. | 215/341 X |
| 3,981,421 | 9/1976 | McDowell, Jr. et al. . | |
| 4,817,831 | 4/1989 | Theisen . | |
| 4,946,055 | 8/1990 | Towns et al. | 215/341 X |

*Primary Examiner*—Stephen Marcus
*Assistant Examiner*—Nova Stucker

[57] ABSTRACT

A container assembly has a container with a body and an elongated neck of generally circular cross section and having threads adjacent its upper end. The neck also has a ring adjacent its lower end with a downwardly and outwardly flaring surface. Engaged on the neck is a cap with an elongated tubular body portion extending downwardly about the neck. The inner wall of the body portion adjacent its upper end has threads which are engaged with the threads of the neck, and the inner wall of the lower end of the body portion tapers downwardly to a greater diameter and resiliently bears against the outer edge of the ring.

5 Claims, 1 Drawing Sheet

CONTAINER WITH AN ALIGNING CAP AND NECK CONSTRUCTION

BACKGROUND OF THE INVENTION

The present invention relates to containers and, more particularly, to containers in which an elongated cap is threaded onto the elongated neck of the container.

Container assemblies fabricated from plastic are now widely employed for various materials, and many containers employ dispensing caps. A popular container design is one which has an elongated neck and a cap with an elongated skirt fitting thereover. To facilitate removal of the cap, only a limited number of threads are provided adjacent the upper end of the cap and neck.

With shallow depth or limited thread profiles, the necessary molding tolerances provide a minimum male to female thread engagement, and this results in a maximum male/female thread clearance. This minimum thread engagement and maximum thread clearance result in a severe cocking problem of the cap on the neck when the cap is assembled to the bottle at the torque necessary to effect a desired seal. This cocking of the cap on the neck is both unsightly and can result in improper alignment of a dispensing cap. It may also increase the torque required by the user to remove the cap from the container if the material creeps in this misthreaded position.

It is an object of the present invention to provide a novel container assembly in which there is minimized or eliminated the tendency for cocking of an elongated skirt on the cap relative to the elongated neck upon which it is seated.

It is also an object to provide such a container assembly in which the components may be readily and economically fabricated and in which the cap may be readily assembled and disassembled from the container.

Another object is to provide such a container assembly in which the elongated cap is centered on the neck of the container so as to provide an attractive appearance.

SUMMARY OF THE INVENTION

It has now been found that the foregoing and related objects may be readily attained in a container assembly which has a container having a body and an elongated neck of generally circular cross section. The neck has threads adjacent the upper end thereof and a ring adjacent the lower end thereof which provides a downwardly and outwardly flaring surface of larger diameter than the threads. Engaged on the neck of the container is a cap having an elongated tubular body portion extending downwardly about the neck and its ring. The inner wall of the body portion adjacent its upper end has threads thereon which are engaged with the threads of the neck. The diameter of the inner surface of the lower end of the body portion increases downwardly, and the body portion resiliently bears against the outer edge of the ring.

Generally, the container neck and the body portion of the cap are elongated and cooperatively dimensioned, and the lower end of the body portion is disposed adjacent the lower end of the neck. The inner wall of the body portion of the cap desirably tapers outwardly from adjacent the threads therein.

The flaring surface is provided by the upper wall of a generally V-shaped ring which also has an inwardly tapering lower wall. The threads comprise not more than four revolutions. Desirably, the outwardly flaring surface extends at an angle of at least 20° to the vertical, and the diameter of the inner surface at the lower end of the body portion is smaller than the outer diameter of the ring.

DETAILED DESCRIPTION OF PREFERRED EMBODIMENT OF THE INVENTION

Figure 1:
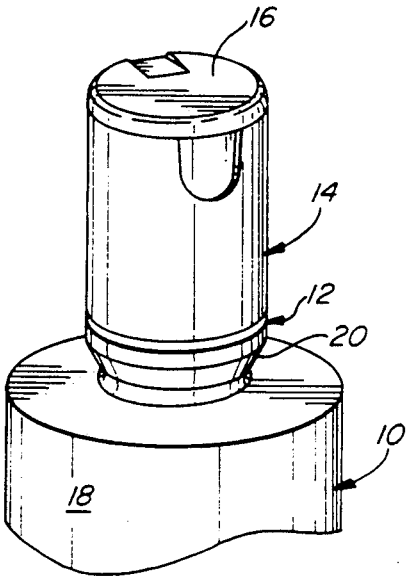
FIG. 1 is a fragmentary perspective view of a container assembly embodying the present invention.

As can be seen from the attached drawing, when the cap 14 is moved downwardly on the neck 12, the lower end of the skirt 28 abuts the downwardly and outwardly sloping upper surface 34 of the bead 32. This produces a natural centering action as the skirt is expanded resiliently outwardly to pass over the outer diameter of the bead 32 during the threading of the cap onto the neck 12.

Turning first to FIG. 1 of the attached drawings, therein fragmentarily illustrated is a container assembly embodying the present invention which has a container generally designated by the numeral 10 with a neck generally designated by the numeral 12 upon which is seated a cap generally designated by the numeral 14. The illustrated embodiment of the cap 14 is one which includes a separate dispensing closure 16 for manipulation to open a dispensing opening to dispense the contents of the container 10, but this is not significant to the structure of the present invention.

Figure 2:
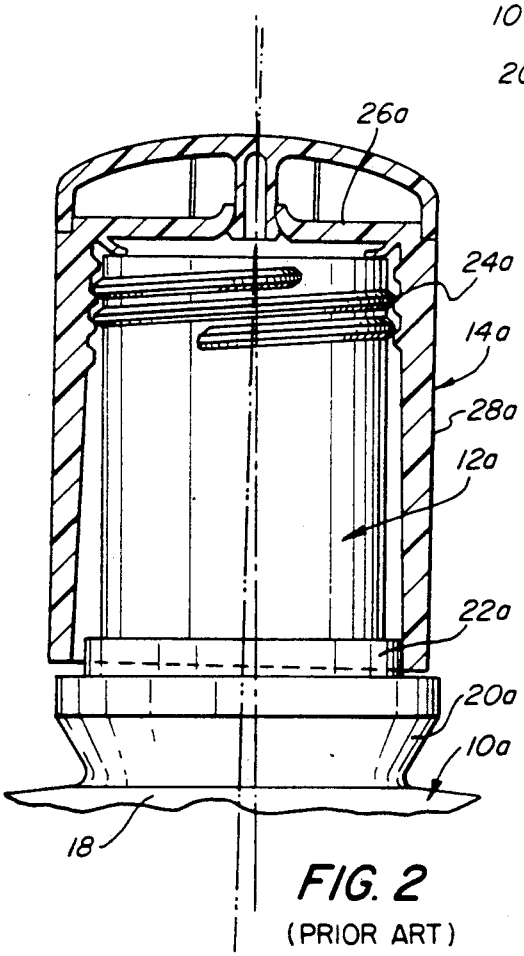
FIG. 2 (PRIOR ART)
FIG. 2 is a fragmentary elevational view in partial section of a prior art version of the container assembly drawn to an enlarged scale.

As seen in FIG. 2, the prior art version of this container design included a container generally designated by the numeral **10*a* with an upstanding neck 12*a* having at the juncture between the neck and the body 18*a* an enlarged boss 20*a* with a smaller diameter collar 22*a* thereabove. Adjacent the upper end of the neck 12*a* are a series of threads 24. The cap 14*a* includes the dispensing closure 16*a* affixed to the end wall 26*a* and an elongated tubular skirt 28*a* which has internal threads 30*a* adjacent the end wall 26*a***.

As seen in FIG. 2, the skirt **28*a* flares downwardly outwardly to provide an elongated cavity which is of larger diameter at its bottom end, and the skirt 28*a* terminates above the boss 20*a* and is spaced outwardly from the collar 22*a*. The threads 30*a* mesh with the threads 24*a* on the neck 12*a* of the container 10*a***.

As can be seen from FIG. 2, the long length of the skirt **28*a* and the relatively small threaded engagement adjacent the top of the skirt 28*a* results in a tendency for cocking or misalignment of the cap 14*a* on the neck 12*a***.

Figure 4:
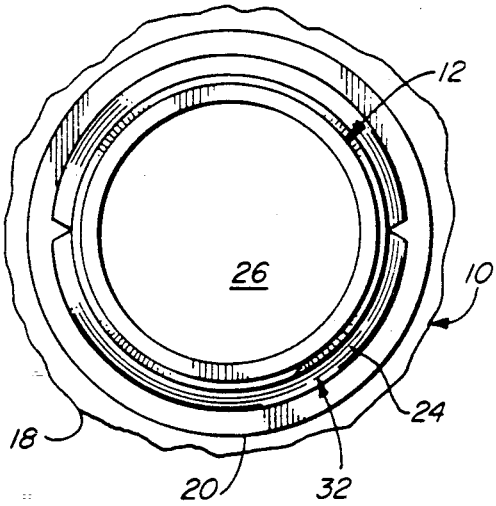
FIG. 4 is a fragmentary plan view of the container of FIG. 3.
Figure 5:
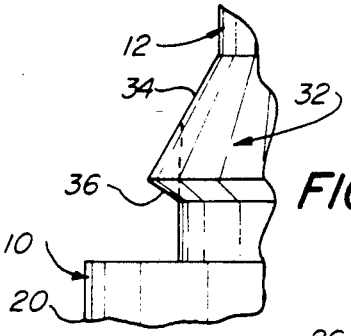
FIG. 5 is a fragmentary side elevational view of the container of FIG. 3 drawn to an enlarged scale.
Figure 3:
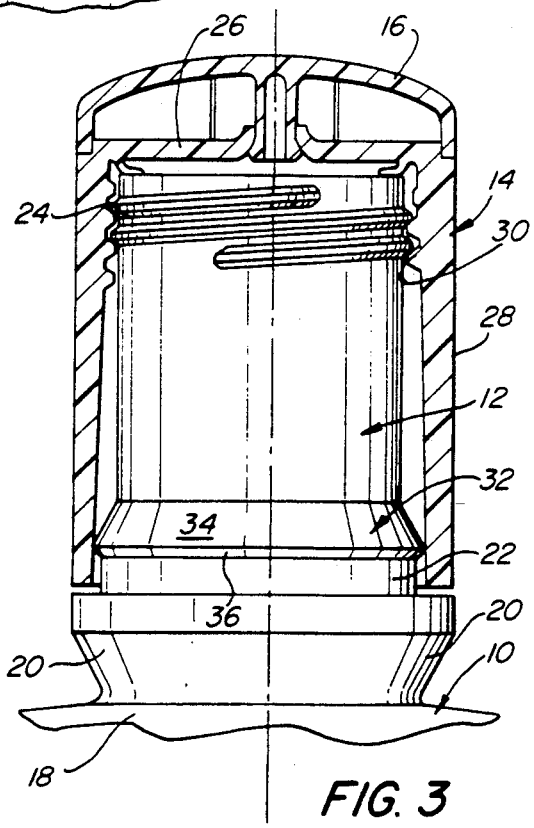
FIG. 3 is a similar view showing the present invention.

In the container assembly of the present invention which is illustrated in FIGS. 3–5, above the collar 22 is a V-shaped ring or bead generally designated by the numeral 32 providing an outwardly and downwardly flaring upper surface 34 and downwardly and outwardly inclined lower surface 36. Although the diameter of the inner surface of the skirt 28 increases downwardly, the diameter of the lower end is less than the outer diameter of the bead 32 so that the skirt 28 resiliently expands as it passes downwardly thereover.

As a result, when the cap 12 is fitted over the neck 16a and pressed downwardly and rotated to engage the threads, the V-shaped bead 32 with its outwardly flaring upper surface 34 tends to center the lower end of the skirt 28 causing the threads 30, 24 to properly engage as the skirt 28 is threaded downwardly. As a result, this resilient expansion of the skirt 28 over the larger diameter portion of the bead 32 produces the desired alignment of the threads and avoids cocking of the cap 14 on the neck 12.

As will be appreciated, the synthetic resin from which the cap is fabricated should be one which provides the necessary resilient deformation to permit the skirt to be expanded outwardly as it is moved downwardly over the outer diameter of the bead. Moreover, to enhance the ability of the skirt to deform, the side wall may be of tapering thickness as is shown in the illustrated embodiment.

Although a larger number of threads may be provided on the neck and skirt, generally the structure of the present invention will function effectively with less than five thread revolutions and as little as two revolutions to provide an effective engagement and seal. It will also be appreciated that the threads must be disposed in the upper portion of the neck and skirt to permit the centering action.

The angle for the downwardly and outwardly sloping surface of the bead may vary, but it should generally be at least 15° from the vertical, and preferably at least 20°. About 30° was proven to be highly effective in commercial structures. The amount of deformation of the lower end of the skirt required for the present invention is relatively small, i.e., 1–6% in diameter with 2–4% being preferred.

As a specific example of effective dimensioning, the following information is provided. A container having a neck with an outer diameter of 0.873 inch and a length of 1.240 inch is provided with a bead having an included angle of 90° and in which the downwardly and outwardly sloping surface is at an angle of 30° to the vertical. The outer diameter of the bead is 1.008 inch. The cap has a skirt of 1.2 inches in length and its inside wall is threaded adjacent the upper end with three complete thread revolutions. The inner wall of the skirt tapers from a diameter of 0.937 inch to 0.980 inch at the lower end thereof, thus providing an interference fit of 0.028 inch. This container construction is found to perform effectively with a manually applied torque of 15 pounds per inch with the skirt being properly centered and sealed on the neck of the container.

Thus, it can be seen from the foregoing detailed description and attached drawings that the container assembly of the present invention may be readily and economically fabricated and readily assembled. The cap is centered on the container neck to avoid unsightly misalignment, and the sealing action is optimized.

Having thus described the invention, what is claimed is:

1. A container assembly comprising:

(a) a container having a body and an elongated neck of generally circular cross section, said neck having threads adjacent the upper end thereof and a ring adjacent but spaced upwardly the lower end thereof providing an upper surface which is downwardly and outwardly flaring to a larger diameter than said threads, said ring being of generally V-shaped cross section and also having an inwardly tapering lower surface; and (b) a cap engaged on said neck and having an elongated tubular body portion extending downwardly about said neck and below said ring thereon, the outer surface of said body portion being of substantially uniform diameter, the inner surface of said body portion adjacent its upper end having threads thereon engaged with said threads of said neck, the inner surface of said body portion below said threads being smooth and tapering outwardly to provide a larger inner diameter for said body portion at the lower end of said cap, said body portion resiliently bearing against the outer edge of said ring.

2. The container assembly of claim 1 wherein said container neck and said body portion of said cap are elongated and cooperatively dimensioned, the lower end of said body portion being disposed adjacent the lower end of said neck.

3. The container assembly of claim 1 wherein said threads comprise not more than four revolutions.

4. The container assembly of claim 1 wherein said outwardly flaring surface extends at an angle of at least 20° to the vertical.

5. The container assembly of claim 1 wherein the outer diameter of said ring is greater than the inner diameter of the lower end of said body portion of said cap.

* * * * *